US005822869A

United States Patent [19]

Metcalf et al.

[11] Patent Number: 5,822,869

[45] Date of Patent: Oct. 20, 1998

[54] RAZOR HANDLE

[75] Inventors: Stephen Cabot Metcalf, West Newton; Charles Bridgham Worrick, III, Hanson, both of Mass.

[73] Assignee: The Gillette Company, Boston, Mass.

[21] Appl. No.: 918,602

[22] Filed: Aug. 22, 1997

Related U.S. Application Data

[62] Division of Ser. No. 630,437, Apr. 10, 1996, Pat. No. 5,787,586.

[51] Int. Cl.[6] ..... B26B 21/52

[52] U.S. Cl. ..... 30/526

[58] Field of Search ..... 30/50, 526

[56] References Cited

U.S. PATENT DOCUMENTS

| | | |
|---|---|---|
| D. 270,197 | 8/1983 | Gray . |
| D. 271,625 | 11/1983 | Gray . |
| D. 277,987 | 3/1985 | Jacobson et al. . |

(List continued on next page.)

FOREIGN PATENT DOCUMENTS

| | | |
|---|---|---|
| 0 020 816 | 1/1981 | European Pat. Off. . |
| 0 203 527 | 5/1986 | European Pat. Off. . |
| 0 353 919 A1 | 7/1989 | European Pat. Off. . |
| 418 726 | 3/1991 | European Pat. Off. . |
| 0 247 974 A2 | 1/1997 | European Pat. Off. . |
| 2457155 | 12/1980 | France . |
| 2 639 280-A1 | 11/1988 | France . |
| 2 409 602 | 2/1974 | Germany . |
| 3518 703 | 5/1985 | Germany . |
| 3635 553 A1 | 4/1988 | Germany . |
| 027 322 | 9/1993 | Germany . |
| 1378085 | 12/1974 | United Kingdom . |
| 1 460 732 | 1/1977 | United Kingdom . |
| 2 086 790 | 5/1982 | United Kingdom . |
| 2 116 470 | 9/1983 | United Kingdom . |
| WO 92/17322 | 10/1992 | WIPO . |
| WO 93/10946 | 6/1993 | WIPO . |
| WO 93/10947 | 6/1993 | WIPO . |
| WO 93/20983 | 10/1993 | WIPO . |
| WO 94/08761 | 4/1994 | WIPO . |
| WO 95/09071 | 4/1995 | WIPO . |
| WO 95/10398 | 4/1995 | WIPO . |
| WO 97/09155 | 3/1997 | WIPO . |

OTHER PUBLICATIONS

PCT/US97/05697, Apr. 8, 1997, Search Report.
Wilkinson Sword (Canada) "Protector" Razor Handle, 1994.
Schick "Silk Effects" Razor Handle, 1994.
Schick Tracer FX Metal Razor Handle, Sep. 1995.
PCT/US/97/05697, International Search Report dated Jan. 21, 1998.

*Primary Examiner*—Hewi-Siu Payer
*Attorney, Agent, or Firm*—Fish & Richardson P.C.

[57] ABSTRACT

A shaving system includes a replaceable shaving cartridge and a shaving razor handle. The replaceable shaving cartridge has a housing carrying blades, a guard, a cap, and a camming surface. The cartridge includes an interconnect member having a pivotal support structure that pivotally supports the housing and a base structure adapted to be removably and fixedly attached to the handle. A shaving razor handle has an elongated hand gripping structure and a cartridge support structure extending from an end of the hand gripping structure. The cartridge support structure has an extension with outer side surfaces that mate with inwardly directed surfaces of a recess on the cartridge and an end surface with an opening. The extension has an asymmetrical shape to ensure proper orientation. A spring-biased plunger is retained in the cartridge support structure and extends through the opening of the cartridge support structure.

17 Claims, 14 Drawing Sheets

U.S. PATENT DOCUMENTS

| | | | |
|---|---|---|---|
| D. 294,528 | 3/1988 | Gray . | |
| D. 354,586 | 1/1995 | Grange . | |
| D. 355,049 | 1/1995 | Yasui . | |
| 3,600,804 | 8/1971 | Brown . | |
| 3,795,979 | 3/1974 | Perry . | |
| 3,878,605 | 4/1975 | Braginetz | 30/526 |
| 3,909,941 | 10/1975 | Bowman et al. . | |
| 3,918,155 | 11/1975 | Atkins . | |
| 3,950,849 | 4/1976 | Perry | 30/47 |
| 3,975,820 | 8/1976 | Torance . | |
| 4,026,016 | 5/1977 | Nissen . | |
| 4,083,104 | 4/1978 | Nissen et al. . | |
| 4,094,063 | 6/1978 | Trotta . | |
| 4,198,746 | 4/1980 | Trotta . | |
| 4,227,302 | 10/1980 | Torrance . | |
| 4,253,235 | 3/1981 | Jacobson . | |
| 4,253,236 | 3/1981 | Jacobson . | |
| 4,253,237 | 3/1981 | Jacobson . | |
| 4,258,471 | 3/1981 | Jacobson . | |
| 4,266,340 | 5/1981 | Bowman . | |
| 4,281,455 | 8/1981 | Dixon et al. . | |
| 4,283,850 | 8/1981 | Douglass et al. . | |
| 4,308,663 | 1/1982 | Ciaffone . | |
| 4,334,563 | 6/1982 | Epel et al. | 145/2 R |
| 4,389,773 | 6/1983 | Nissen et al. . | |
| 4,403,414 | 9/1983 | Kiraly et al. . | |
| 4,411,065 | 10/1983 | Trotta . | |
| 4,413,411 | 11/1983 | Trotta . | |
| 4,422,237 | 12/1983 | Trotta . | |
| 4,443,940 | 4/1984 | Francis et al. . | |
| 4,446,619 | 5/1984 | Jacobson . | |
| 4,475,286 | 10/1984 | Saito . | |
| 4,488,357 | 12/1984 | Jacobson . | |
| 4,492,024 | 1/1985 | Jacobson . | |
| 4,492,025 | 1/1985 | Jacobson . | |
| 4,514,904 | 5/1985 | Bond . | |
| 4,516,321 | 5/1985 | Francis . | |
| 4,658,505 | 4/1987 | Williams . | |
| 4,715,120 | 12/1987 | McGready . | |
| 4,739,553 | 4/1988 | Lazarchik . | |
| 4,756,082 | 7/1988 | Apprille, Jr. . | |
| 4,785,534 | 11/1988 | Lazarchik . | |
| 4,797,998 | 1/1989 | Motta . | |
| 4,949,457 | 8/1990 | Burout, III . | |
| 4,970,784 | 11/1990 | Althaus et al. . | |
| 4,985,995 | 1/1991 | Coffin . | |
| 5,010,646 | 4/1991 | Neamtu . | |
| 5,016,352 | 5/1991 | Metcalf . | |
| 5,027,511 | 7/1991 | Miller . | |
| 5,031,319 | 7/1991 | Althaus . | |
| 5,050,301 | 9/1991 | Apprille . | |
| 5,107,590 | 4/1992 | Burout, III et al. . | |
| 5,157,834 | 10/1992 | Chen et al. . | |
| 5,256,048 | 10/1993 | Jacobs . | |
| 5,331,740 | 7/1994 | Carson, III et al. . | |
| 5,347,717 | 9/1994 | Ts'ai . | |
| 5,403,534 | 4/1995 | Kim . | |
| 5,426,851 | 6/1995 | Gilder et al. . | |
| 5,469,621 | 11/1995 | Alsept et al. . | |
| 5,497,551 | 3/1996 | Apprille, Jr. | 30/526 |
| 5,526,567 | 6/1996 | Carson, III et al. . | |
| 5,687,485 | 11/1997 | Shurtleff et al. | 30/526 |

RAZOR HANDLE

This is a divisional of application Ser. No. 08/630,437, filed Apr. 10, 1996, U.S. Pat. No. 5,787,586.

BACKGROUND OF THE INVENTION

The invention relates to shaving systems having handles and replaceable cartridges.

Shaving systems often consist of a handle and a replaceable cartridge in which one or more blades are mounted in a plastic housing. After the blades in a cartridge have become dull from use, the cartridge is discarded, and replaced on the handle with a new cartridge. In some shaving systems the blades are resiliently mounted with respect to the cartridge housing and deflect under the force of skin contact during shaving. In some shaving systems the connection of the cartridge to the handle provides a pivotal mounting of the cartridge with respect to the handle so that the cartridge angle adjusts to follow the contours of the surface being shaved. In such systems, the cartridge can be biased toward an at rest position by the action of a spring-biased plunger (a cam follower) carried on the handle against a cam surface on the cartridge housing.

SUMMARY OF THE INVENTION

In general, in one aspect, the invention features a replaceable shaving cartridge having a housing carrying blades, a guard, a cap, and a camming surface. The cartridge also includes an interconnect member having a pivotal support structure that pivotally supports the housing and a base structure adapted to be removably and fixedly attached to a handle. The interconnect member provides access to the camming surface by a spring-biased cam follower on the handle.

In general, in another aspect, the invention features a replaceable shaving cartridge having a housing carrying blades, a guard, and a cap. The cartridge also includes an interconnect member having a pivotal support structure that pivotally supports the housing about a pivot axis and a base structure adapted to be removably and fixedly attached to an extension at an end of a handle. The handle extension has outer side surfaces, and the base structure has a recess with inwardly directed side surfaces that engage a sufficient number of the outer side surfaces on the handle extension so as to immovably position the base structure with respect to the handle extension. The base structure also has an opening to the recess along an axis that is nonparallel with respect to the pivot axis.

In general, in another aspect, the invention features a replaceable shaving cartridge having a housing carrying blades, a guard, and a cap. The cartridge also includes an interconnect member having a base structure adapted to be removably and fixedly attached to a handle extension that extends from an end of a handle along an extension axis. The handle extension has outer side surfaces and an asymmetrical section in a plane through the side surfaces perpendicular to the extension axis. The base structure has a recess that mates with the extension and has inwardly directed side surfaces that engage a sufficient number of the outer side surfaces along the asymmetrical extension so as to immovably position the base with respect to the extension and to ensure proper orientation of the housing with respect to the handle. The base structure has an opening to the recess along an axis that is perpendicular to the plane.

Certain implementations of the invention include one or more of the following features.

In certain implementations: the housing has a substantially unobstructed rinsing region under the blades; the pivotal support structure has a pivot axis in front of the blades in the region of the guard. The shape of the recess in the base may be a trapezoid, have six sides and/or be flat in a direction parallel to the blades.

In certain implementations: the base structure is snap fitted onto the handle; the base structure has a detent and the handle has a mating depression adapted to receive the detent; alternatively the handle has a detent and the base structure has a mating depression adapted to receive the detent; plural detents and depressions are used. Alternatively, the base structure is latchably secured to the handle.

In certain implementations: the housing and the interconnect member are made from separate pieces of plastic. Alternatively, the housing and the interconnect member are made of the same piece of plastic, and the pivotal support structure is provided by a living hinge. Alternatively, the pivotal support structure is provided by a flexible plastic hinge portion that is made of material that is more flexible than the housing and connects the housing and interconnect member at a pivot region.

In certain implementations: the pivotal support structure of the interconnect member includes two arms having ends retained in recesses with openings at two sides of the housing; the ends of the arms snap into the recesses of the housing; the recesses are covered by clips to retain the ends of the arms within the recesses; the arms have lower surfaces that slide on upwardly-directed arcuate surfaces on the housing.

In certain implementations: the housing has a camming surface for receiving a cam follower surface on a spring-biased plunger from the interconnect member; the interconnect member has an opening to receive the spring-biased plunger; the camming surface permits pivoting in only one direction from a rest position or permits different amounts of pivoting forward and backward from the rest position; the housing also has front and back stop surfaces that interact with the interconnect member.

In certain implementations: the blades are loaded into the housing from a top side of the housing; the blades are retained in the housing by clips that retain the interconnect member at a bottom side of the housing; the housing carries three blades; the blades are spring biased (e.g., the blades may be resiliently supported in the housing by spring arms integral with the housing; the guard is made of an elastomer and has flexible fins to engage the user's skin.

In general, in another aspect, the invention features a method of making a replaceable shaving cartridge. A housing for carrying blades, an interconnect member having a pivotal support structure and a base structure adapted to be removably and fixedly attached to a handle are provided. The pivotal support structure is inserted into a recess in the housing. The pivotal support structure is retained in the recess.

Implementations of the invention may include one or more of the following features. The retaining step includes snap fitting and/or adding a clip. The blades may be added to the housing before adding a clip to retain the blades with the clip.

In general, in another aspect, the invention features a shaving razor handle having an elongated hand gripping structure and a cartridge support structure extending from an end of the hand gripping structure. The cartridge support structure has outer side surfaces that mate with inwardly directed surfaces of a recess on a cartridge and an end surface with an opening. A spring-biased plunger is retained in the cartridge support structure and extends through the opening of the cartridge support structure.

Certain implementations of the invention may include one or more of the following features.

In certain implementations: the outer side surfaces provide an asymmetrical shape to ensure proper orientation of the cartridge with respect to the handle; the spring-biased plunger is guided by a slot in the cartridge support structure; an ejector and snap fit ejector button are used to eject the cartridge; the ejector button has an inclined surface to facilitate attachment to the cartridge support structure; the ejector button slides on a guide surface in the cartridge support structure when pushing the ejector; the cartridge support structure has a track, and the ejector button has a groove that slides on the track.

In certain implementations: the plunger and the ejector are biased in opposite directions by a spring; the plunger has a stop which retains the plunger within the cartridge support structure; the plunger has an arm with an inclined surface, the inclined surface and the stop extending above the plunger and being retained in the slot in the cartridge support structure to guide the plunger; the stop has an inclined surface to permit the stop to be inserted into the cartridge support structure; the plunger has a rear guide member to further guide the plunger.

In certain implementations: the first end of the spring biases the plunger against the stop, and a second end of the spring biases the ejector against a back surface of the cartridge support structure; the ejector button and the cartridge support structure have spring support portions to capture and guide the spring.

In certain implementations: the ejector is a U-shaped clip having ejector arms and narrower portions that engage the ejector button, and the cartridge support structure has a mating guide surface along which the ejector arms and the narrower portions slide.

In certain implementations: the cartridge support structure and the elongated gripping structure are made of a single piece of plastic. Alternatively, the cartridge support structure and the elongated gripping structure are made from separate pieces of plastic.

In general, in another aspect, the invention features a shaving razor handle having an elongated hand gripping structure and a cartridge support structure extending from an end of the hand gripping structure. The elongated hand gripping structure includes a gripping portion including an elastomeric plastic outer gripping layer and a nonelastomeric plastic support layer thereunder having extensions that are press-fitted into the elongated hand gripping structure.

In certain implementations: the elongated hand gripping structure is made of plastic and defines a recess in which a weight is disposed; the plastic is metallic-colored plastic.

In general, in another aspect, the invention features a method of making a shaving razor handle. An elongated hand gripping structure and an attached cartridge support structure extending from an end of the elongated hand gripping structure and having a recess therein with an inwardly directed stop surface are provided. A spring and a plunger having an outwardly directed stop surface are inserted into the recess until the outwardly directed stop surface passes the inwardly directed stop surface and is retained by the inwardly directed stop surface.

Certain implementations of the invention may include one or more of the following features: the ejector is inserted into the recess; an ejector button is inserted into the cartridge support structure to push the ejector.

In general, in another aspect, the invention features a razor including a handle and a replaceable shaving cartridge including a pivotal housing and an interconnect member. The housing carries blades, a guard, a cap, and has a camming surface. The interconnect member has a pivotal support structure that pivotally supports the housing and a central base structure having a recess and an opening from the recess facing the camming surface. The handle has a cartridge support structure shaped to mate with the recess and a spring biased plunger with a cam follower surface extending from the cartridge support structure and through the opening to act on the camming surface to bias the housing.

In general, in another aspect, the invention features a razor having a replaceable shaving cartridge including a housing and an interconnect member. The housing carries at least one blade, a guard, and a cap. The interconnect member has a pivotal support structure and a central base structure with a recess. A handle has a cartridge support structure including an extension shaped to mate with the recess, and a stepped portion has the same shape as the central base structure so as to continue the shape from the cartridge support structure to the central base structure.

Certain implementations of the invention may include one or more of the following features: the central base structure may be flat along an axis that is parallel to the blade, and may also have a curved or beveled shape.

Other advantages and features of the invention will be apparent from the detailed description of preferred embodiments thereof and from the claims.

DESCRIPTION OF THE PREFERRED EMBODIMENTS

Figure 1:
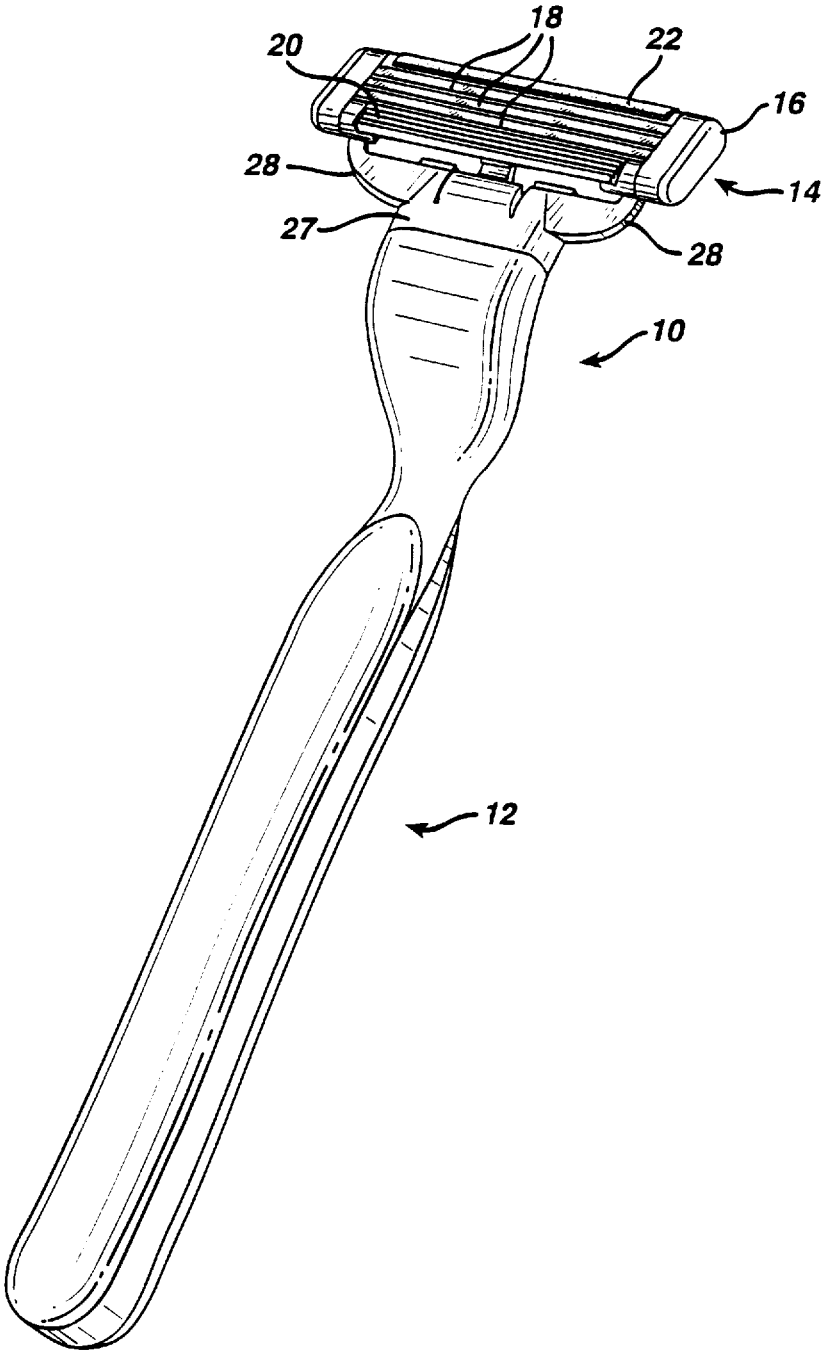
FIG. 1 is a perspective view of a shaving razor according to the invention.
Figure 2:
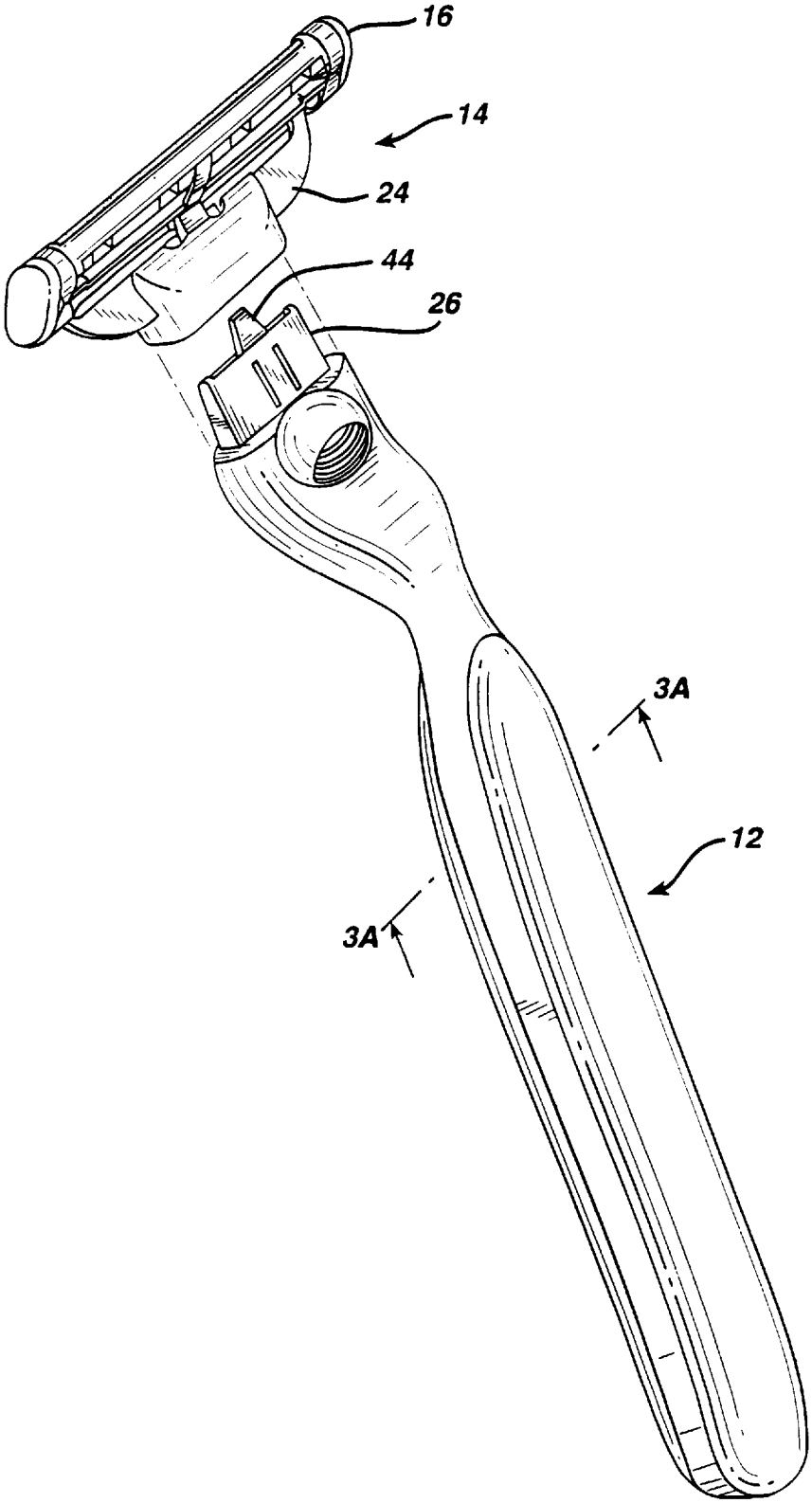
FIG. 2 is a perspective view showing a handle and a replaceable cartridge of the FIG. 1 razor separated from each other.
Figure 19:
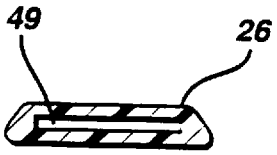
FIG. 19 is a sectional view of an extension of the FIG. 2 handle.

Referring to FIGS. 1 and 2, shaving razor 10 includes handle 12 and replaceable shaving cartridge 14. As shown in FIG. 2, cartridge 14 is removable from handle 12. Cartridge 14 includes housing 16, which carries three blades 18, guard 20 and cap 22. Cartridge 14 also includes interconnect member 24 on which housing 16 is pivotally mounted. Interconnect member 24 includes base 27, which removably and fixedly attaches to asymmetrical extension 26 (FIG. 19) on handle 12, and two arms 28 that pivotally support housing 16 at its two sides.

Figure 3:
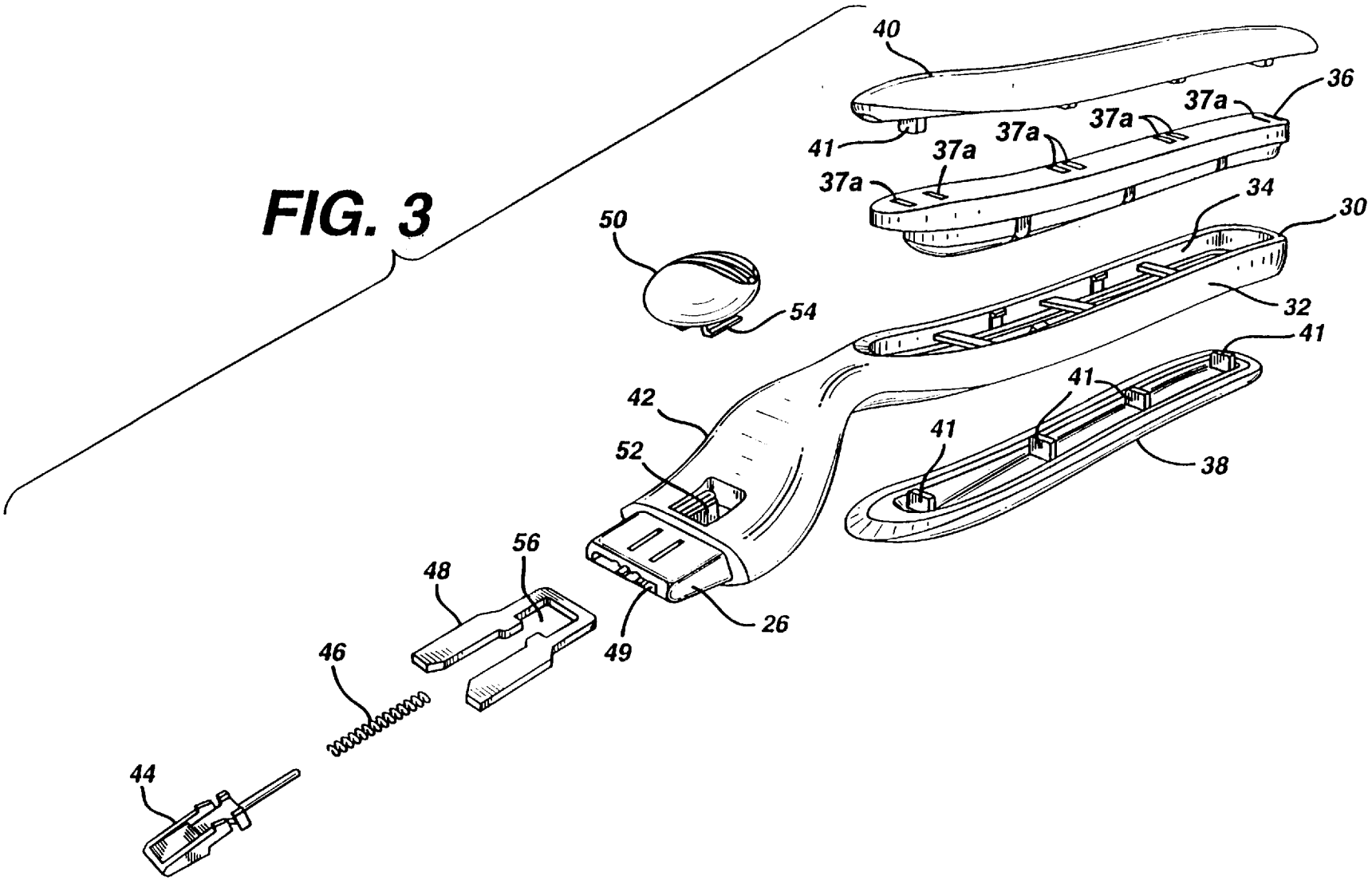
FIG. 3 is an exploded view of the components of the FIG. 2 handle.
Figure 3A:
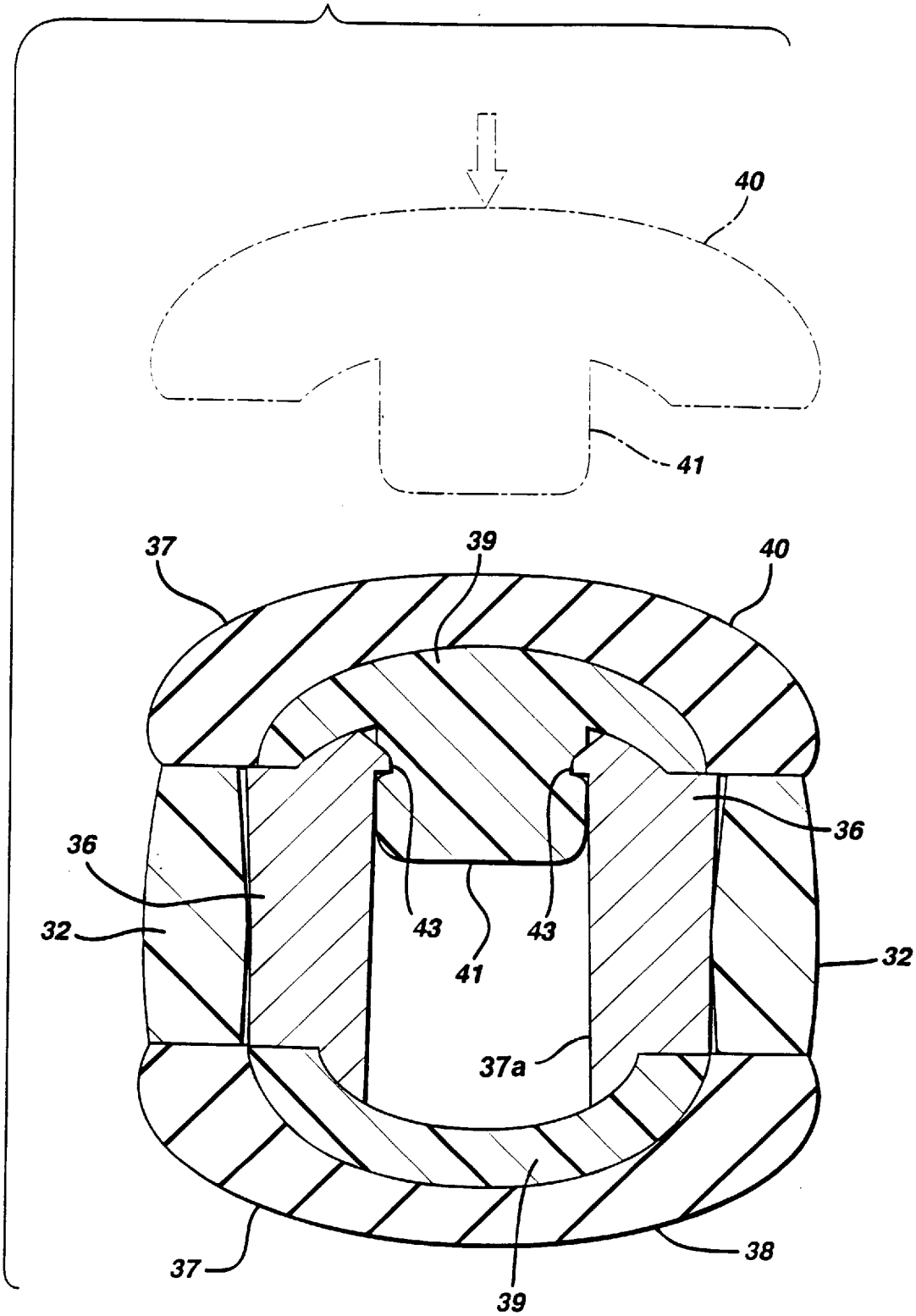
FIG. 3A is a diagrammatic sectional view, taken at 3A—3A of FIG. 2, of the FIG. 2 handle.

Referring to FIG. 3, handle 12 includes metallic colored plastic component 30 as a primary structural member on which the remaining components are mounted. Elongated portion 32 of component 30 has recess 34 for receiving metal (e.g., zinc) weight 36, which along with walls of portion 32 are sandwiched between plastic gripping portions 38 and 40 to provide an elongated hand-gripping structure in the completed unit. Elongated portion 32 acts as a frame member of the elongated hand gripping structure of handle 12. Plastic gripping portions 38 and 40 are made of an elastomeric plastic outer gripping layer 37 (e.g., thermoplastic elastomer) and a nonelastomeric plastic support layer 39 (e.g., of acrylonitrile butadiene styrene) thereunder made by two-color molding. The nonelastomeric plastic support layer has extensions 41 that are press-fitted into slots 37*a* of weight 36 in elongated portion 32. FIG. 3A illustrates the undeformed shape of extension 41 (in phantom) and the interference fit made by it at opposing projections 43 in a slot 37*a;* as appears from FIG. 3A, the opposing projections 43 define a dimension between them that is not greater than the corresponding dimension of extension 41.

Cartridge support structure 42 extends from the end of elongated portion 32. It includes trapezoid shaped extension 26 (see FIG. 19) and the components that provide a spring-biased plunger action for biasing of housing 16 relative to interconnect member 24. It also includes components that provide for ejection of cartridge 14 from handle 12.

Spring-biased plunger 44, spring 46, and U-shaped ejector 48 are received within recess 49 of cartridge support structure 42. Ejector button 50 is received in opening 52 on the top surface of support structure 42 and has bottom extensions 54 that are received within rectangular region 56 at the back narrow portion of ejector 48.

Figure 4:
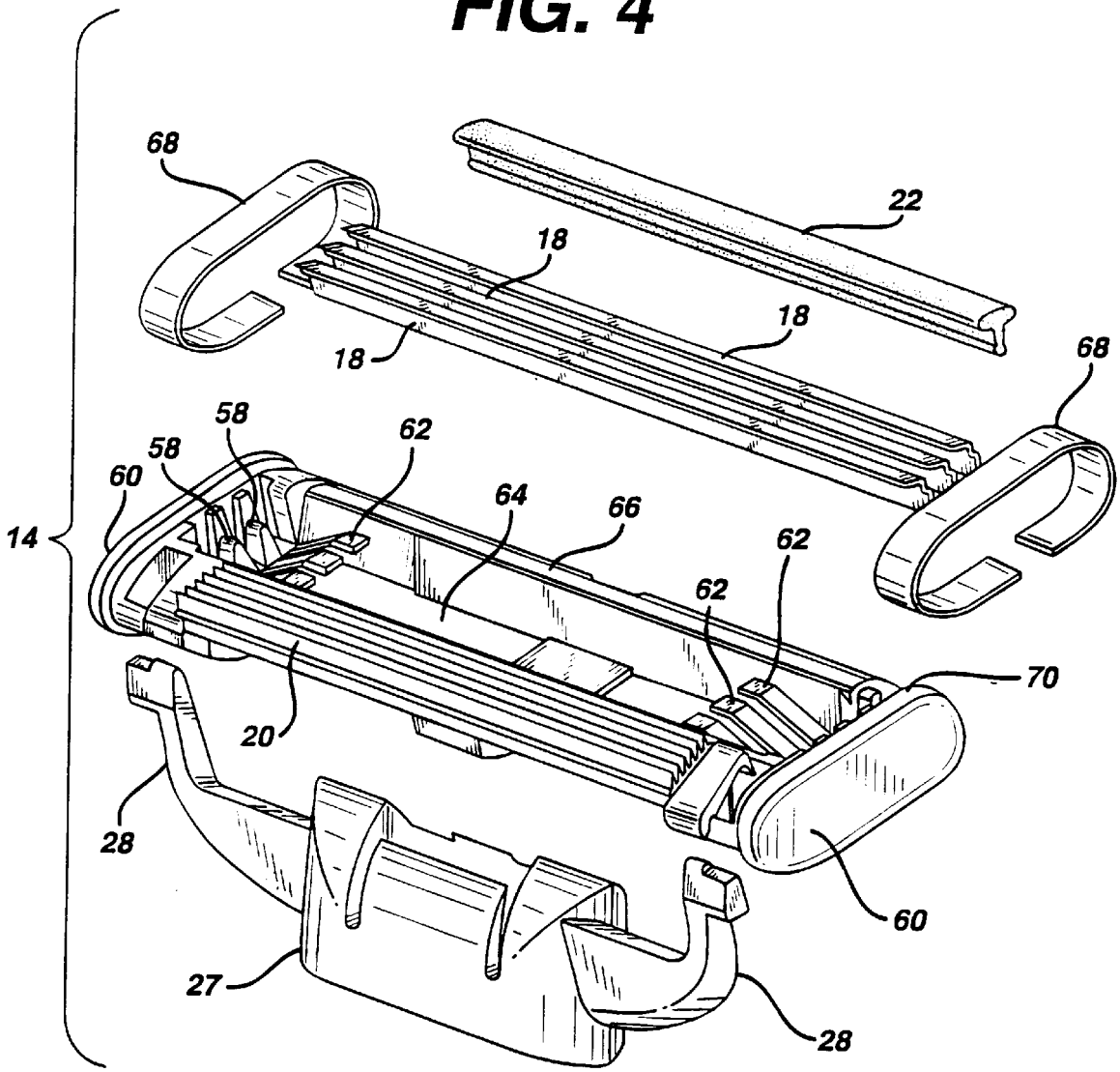
FIG. 4 is an exploded view of the components of the FIG. 2 replaceable cartridge.
Figure 4A:
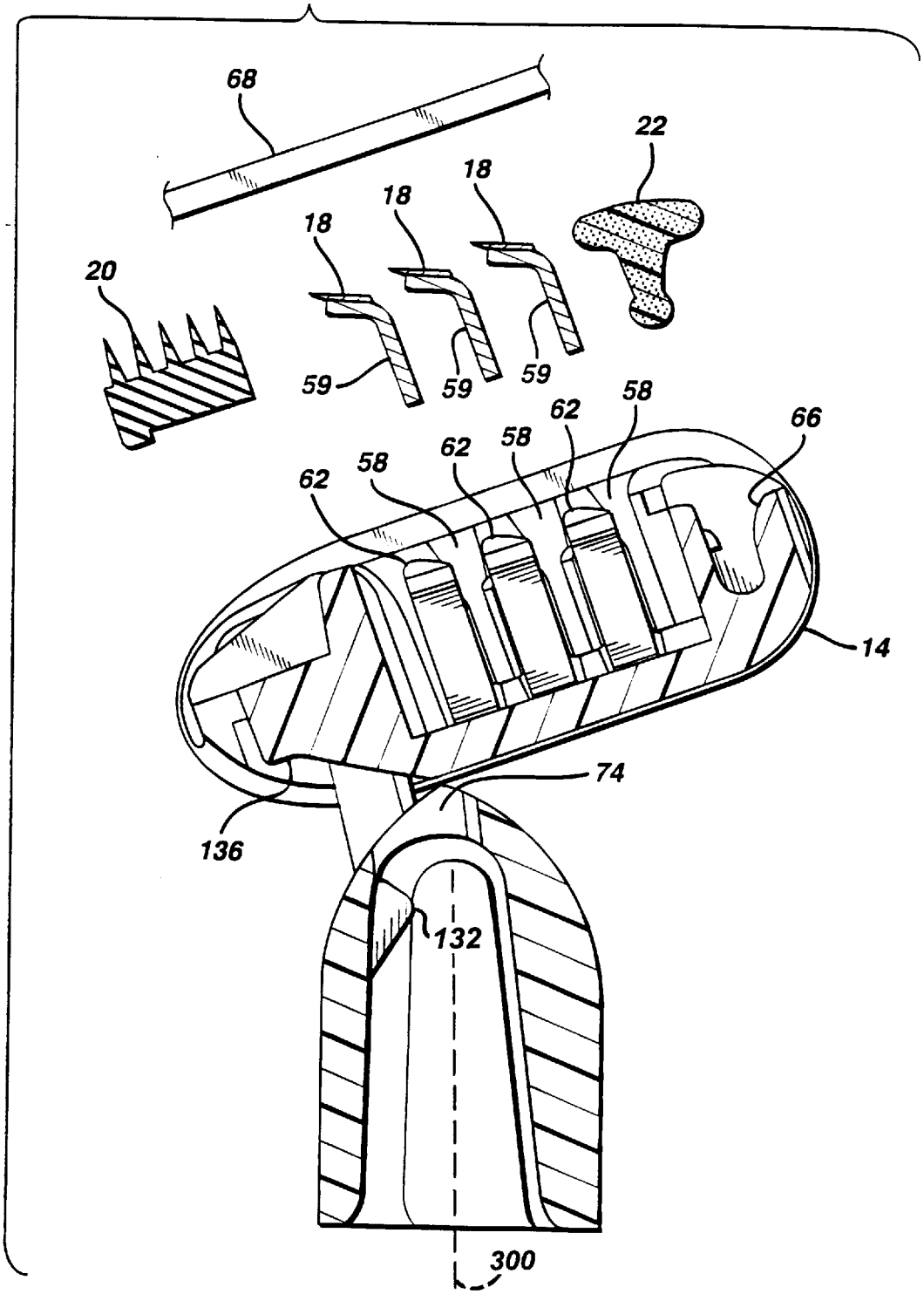
FIG. 4A is an exploded sectional view, taken at 4A—4A of FIG. 14, of the components of the FIG. 2 replaceable cartridge.
Figure 15:
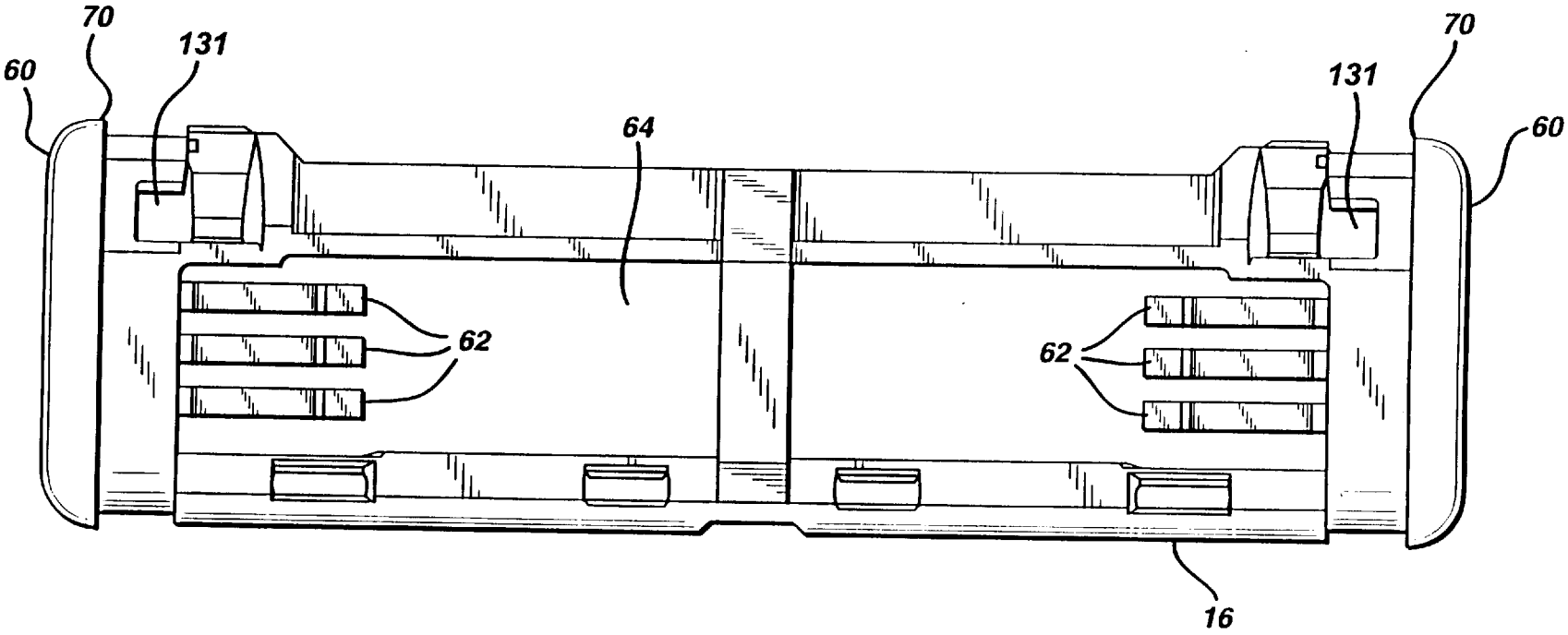
FIG. 15 is a bottom view of the FIG. 13 replaceable cartridge.

Referring to FIGS. 4, 4A and 15, housing 16 of cartridge 14 has inwardly facing slots 58 in side walls 60 for receiving the edges of the base portions 59 of blades 18 and respective resilient arms 62 (FIG. 15) on which each blade 18 is resiliently supported. Blades 18 are located in a substantially unobstructed region 64 between side walls 60 to provide for ease of rinsing of the cartridge during use.

Cap 22 provides a lubricious shaving aid and is received in slot 66 at the rear of housing 16. Cap 22 may be made of a material comprising a mixture of a hydrophobic material and a water leachable hydrophilic polymer material, as is known in the art and is described, e.g., in U.S. Pat. Nos. 5,113,585 and 5,454,164, which are hereby incorporated by reference. Guard 20 includes a finned elastomeric unit mounted at the front of housing 16 to engage and stretch the user's skin; other skin engaging protrusions, e.g., as described in U.S. Pat. No. 5,191,712, which is hereby incorporated by reference, can be used. Clips 68 are secured at the respective sides of housing 16 inside of raised edges 70 of side walls 60 in order to retain blades 18 within housing 16 and to locate the cutting edges of the spring-biased blades at a desired exposure.

Clips 68 also wrap around the bottom of housing 16 and prevent the removal of pivotal support ends 72 of arms 28 of interconnect member 24. Base structure 27 has an opening 74 at the top through which spring-biased plunger 44 of the handle passes to act on a cam surface (not shown in FIG. 4) on the bottom of housing 16. Base structure 27 may have a curved or beveled shape.

Figure 5:
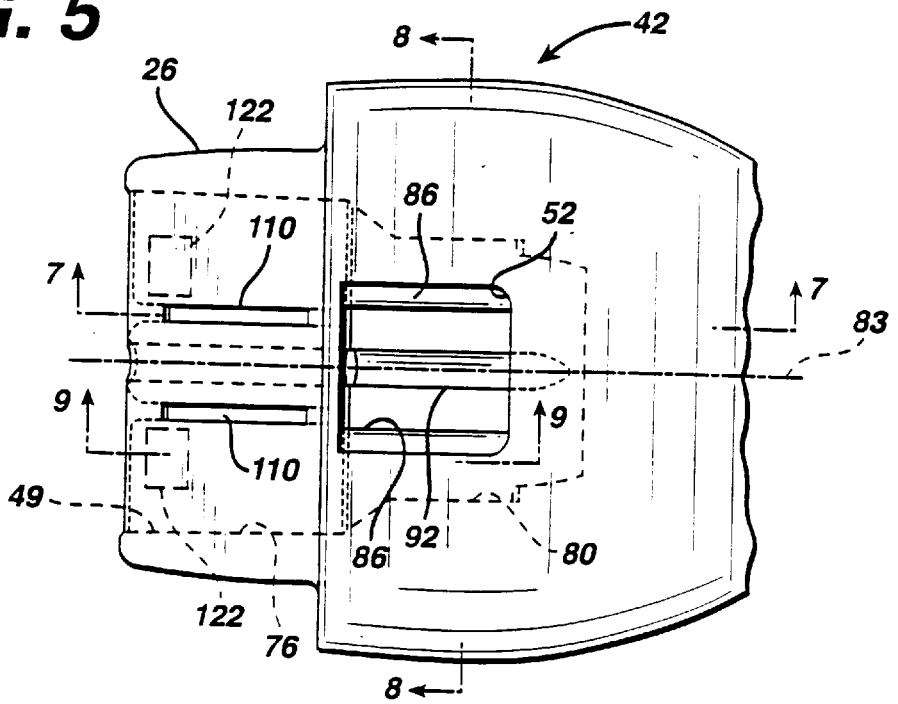
FIG. 5 is a partial plan view showing a cartridge support structure at the end of the FIG. 2 handle.

FIGS. 5–12 and 19 show the details of plunger 44, ejector 48, button 50, and cartridge support structure 42. Referring to FIG. 5, recess 49 within cartridge support structure 42 has wide front portion 76 for receiving arms 78 of ejector 48 (FIG. 10) and a narrower portion 80 for receiving narrower portion 82 of ejector 48. Rectangular region 56 at narrow portion 82 of ejector 48 is generally aligned with opening 52 at the upper surface of support structure 42, though rectangular region 56 is movable with respect to opening 52 along slide axis 83 as ejector 48 is pushed outward by ejector button 50.

Figure 8:
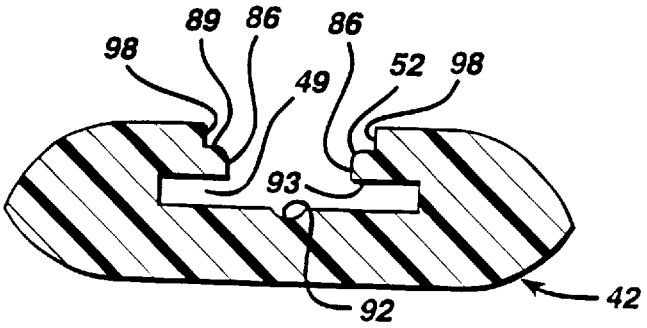
FIG. 8 is a sectional view, taken at 8—8 of FIG. 5, of the FIG. 5 cartridge support structure.
Figure 12:
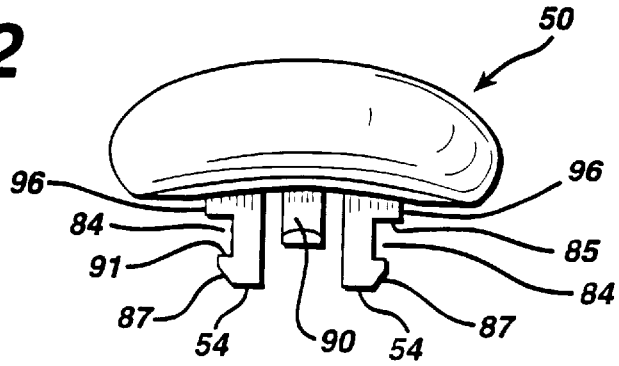
FIG. 12 is an elevation of an ejector button used in the FIG. 5 cartridge support structure.

Referring to FIGS. 8 and 12, each extension 54 of ejector button 50 has an outwardly directed groove 84 that slides on a respective track 86 within opening 52 along axis 83. The upper surfaces 85 defining grooves 84 slide on the upper surfaces 89 of tracks 86, and the lower surfaces 91 defining groves 84 effect capture on or abut the lower surfaces 93 of tracks 86. Extensions 54 have inclined surfaces 87 that coact with the curved upper corners of tracks 86 to deflect extensions 54 inward as button 50 is inserted into cartridge support structure 42. When grooves 84 on extensions 54 align with tracks 86, extensions 54 substantially return to their undeflected position and lock ejector button 50 in place within opening 52. Ejector 48 is placed within recess 49 before button 50 is inserted so that the ends of extensions 54 will be located within rectangular region 56 so as to retain ejector 48 within cartridge support structure 42. Extensions 54 push against surfaces 94 of ejector 48 when ejector button 50 is pushed toward the end of handle 12. After button 50 has been inserted, upper vertical surfaces 96 of extensions 54 sit within the space between upper surfaces 98 of opening 52.

Spring 46 (FIG. 3) extends through the space between extensions 54 and is guided by the curved lower surface of spring guide 90 on button 50. As shown in FIG. 8, the lower surface defining recess 49 also has a curved central portion 92 to receive and guide spring 46.

Figure 6:
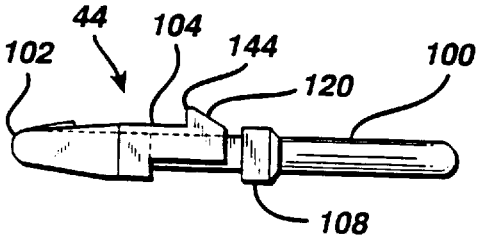
FIG. 6 is an elevation of a plunger of the FIG. 2 handle.
Figure 7:
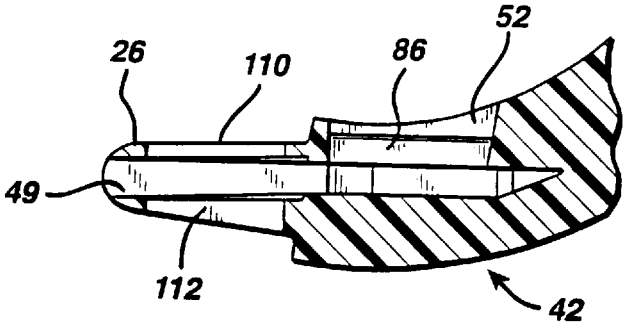
FIG. 7 is a partial sectional view, taken at 7—7 of FIG. 5, of the FIG. 5 cartridge support structure.
Figure 11:
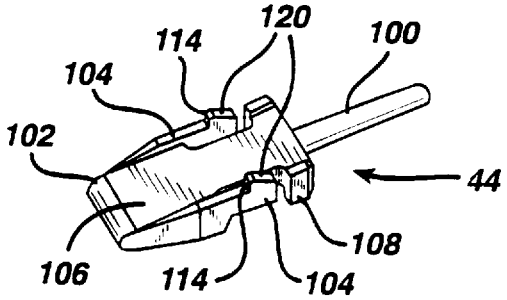
FIG. 11 is a perspective view of the FIG. 6 plunger.

As shown in FIGS. 6 and 11, plunger 44 has flat body 106, cylindrical rear extension 100 for receiving spring 46 (FIG. 3), curved front cam follower portion 102 for acting on the camming surface 136 (FIG. 18) of housing 16, side arms 104, and aligned rear guide portions 108. Flat body 106 is positioned within the flat front portion of recess 49 (FIG. 6). The portions of side arms 104 and aligned rear guide portions 108 above and below body 106 are located within slots 110, 112 located on both sides of asymmetrical extension 26. Side arms 104 have stop surfaces 114 that prevent forward movement of plunger 44 beyond the front end of slot 110 or 112. The portions of side arms 104 and guide portions 108 above and below recess 49 within slots 110, 112 act as guides to guide the sliding action of plunger 44 along axis 83.

Side arms 104 have inclined surfaces 120 to cause downward biasing of arms 104 when plunger 44 is inserted into recess 49 until stop surfaces 114 advance past the front ends of slots 110, 112 and stop surfaces 114 snap into position within the respective slot. Because slots 110, 112 are provided on both sides of asymmetrical extension 26, plunger 44 can be inserted in either position orientation, with the stop surface 114 directed into slot 110 or 112.

Figure 9:
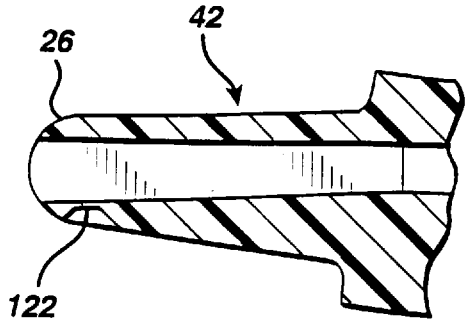
FIG. 9 is a partial sectional view, taken at 9—9 of FIG. 5, of the FIG. 5 cartridge support structure.
Figure 10:
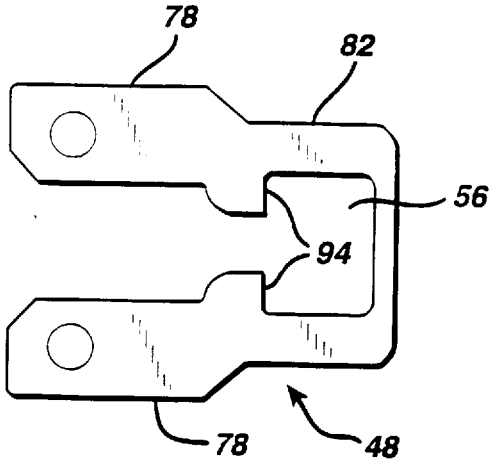
FIG. 10 is a plan view of an ejector used in the FIG. 5 cartridge support structure.

Referring to FIGS. 5 and 9, one surface of asymmetrical extension 26 includes depressions 122 for receiving detents within base structure 27 of cartridge 14 in order to retain cartridge 14 on extension 26.

In manufacture of handle 12, the hand gripping components are assembled by first inserting weight 36 into recess 34, and then press-fitting extensions 41 of components 38, 40 into aligned slots 37*a* in weight 36. Weight 36 and components 38, 40 are locked in place by the interference fit between extensions 41 and projections 43, and elastomeric layer 37 deforms to provide a seal between the side walls of elongated portion 32 of plastic component 30 and weight 36. (FIG. 3A shows the undeformed shapes of the components in phantom.)

In assembling the components of cartridge support structure 42 at the end of handle 12, ejector 48 is first inserted into recess 49. Spring 46 and plunger 44 are then inserted. Inclined surfaces 120 of side arms 104 are biased during insertion toward the middle of the recess and then snap into slot 110 or 112 (depending on plunger orientation) locking plunger 44, spring 46, and ejector 48 in place in cartridge support structure 42. Spring 46 acts both to bias ejector 48 backward against the surfaces of recess 49 and button extensions 54 and to bias plunger 44 forward, stop surfaces 114 being biased against the forward edges of slot 110 or 112. Button 50 is inserted into opening 52 after ejector 48 has been inserted into position. Inclined surfaces 87 are biased inward by the curved upper portions of rails 86, and ejector button 50 is snapped into place with tracks 86 being located within grooves 84.

Figure 13:
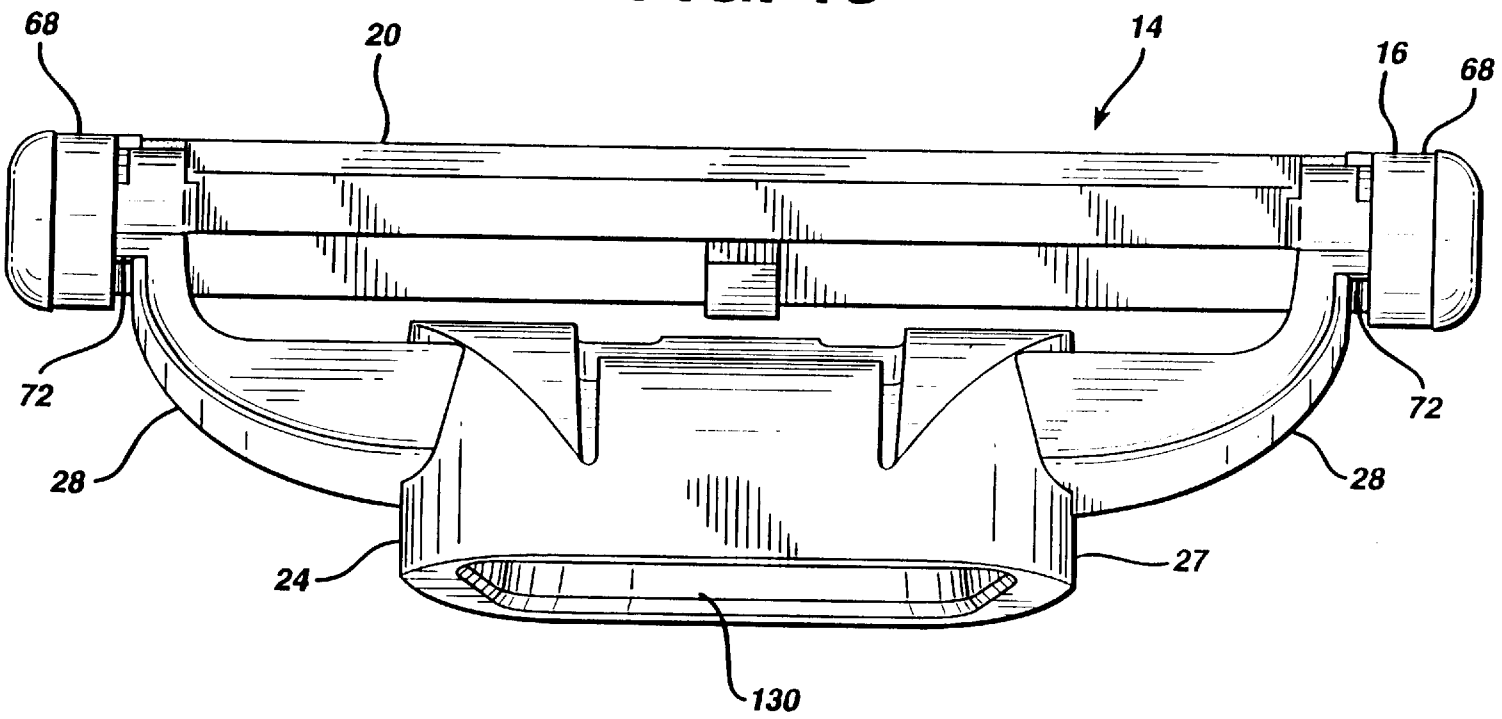
FIG. 13 is an elevation of the FIG. 2 replaceable cartridge.
Figure 14:
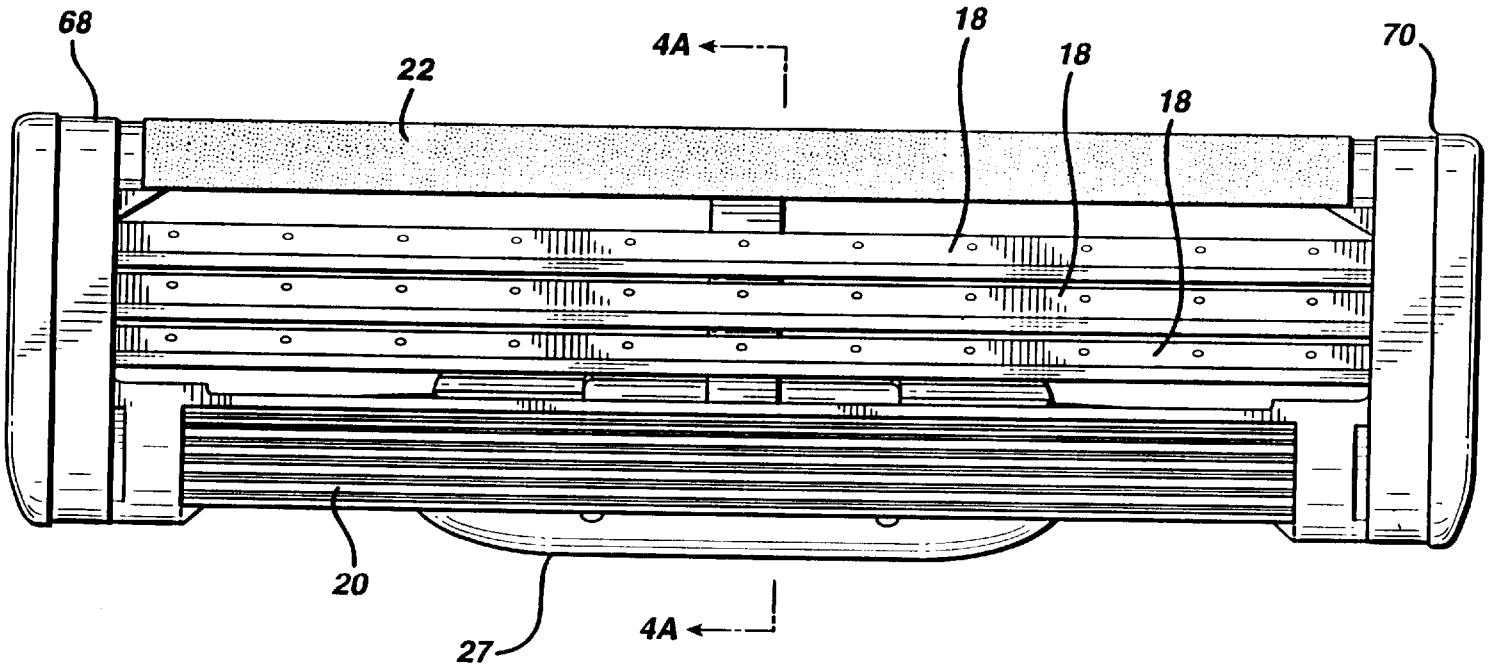
FIG. 14 is a plan view of the FIG. 13 replaceable cartridge.

FIGS. 13–18 show further details of replaceable cartridge 14 and its pivotal movement. Referring to FIG. 13, interconnect member 24 is shown assembled to housing 16 with pivotal support ends 72 retained by clips 68. It is seen that base structure 27 has a trapezoidal shaped recess 130 that extends has the same shape as extension 26 and mates with extension 26.

Referring to FIG. 15, housing 16, shown before the other cartridge components have been assembled on it, has recesses 131 in which the pivotal support ends 72 on the ends of arms 28 are received. Arms 28 deflect as support ends 72 are inserted through the openings to recesses 131 and then snap back to an undeflected orientation after ends 72 are within recesses 131 to retain ends 72 in place.

Referring to FIGS. 4A and 9, detents 132 within recess 130 of base 27 mate with depressions 122 of asymmetrical extension 26. At the top of recess 130 is opening 74 which permits spring-biased plunger 44 to extend through base 27 and to interact with camming surface 136 on the bottom of housing 16.

Figure 17:
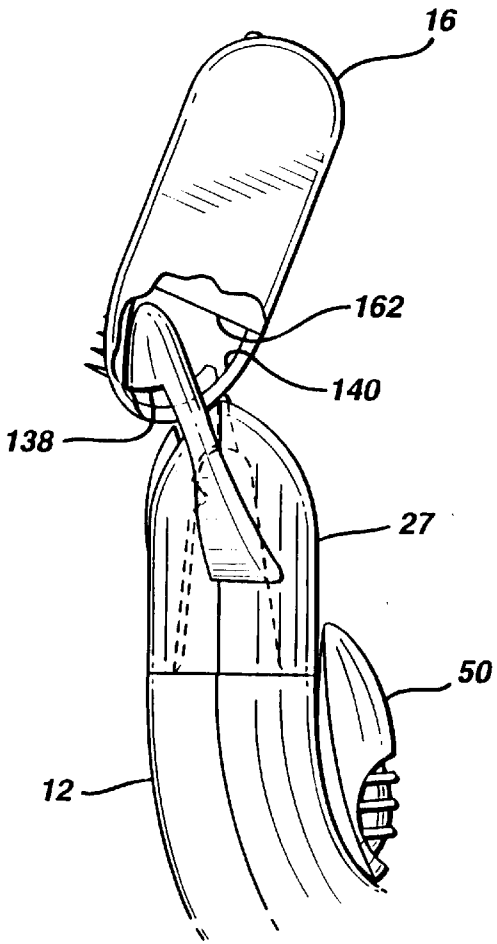
FIG. 17 is a side view, partially broken away, of the FIG. 13 cartridge in a biased position after connection to a handle.
Figure 16:
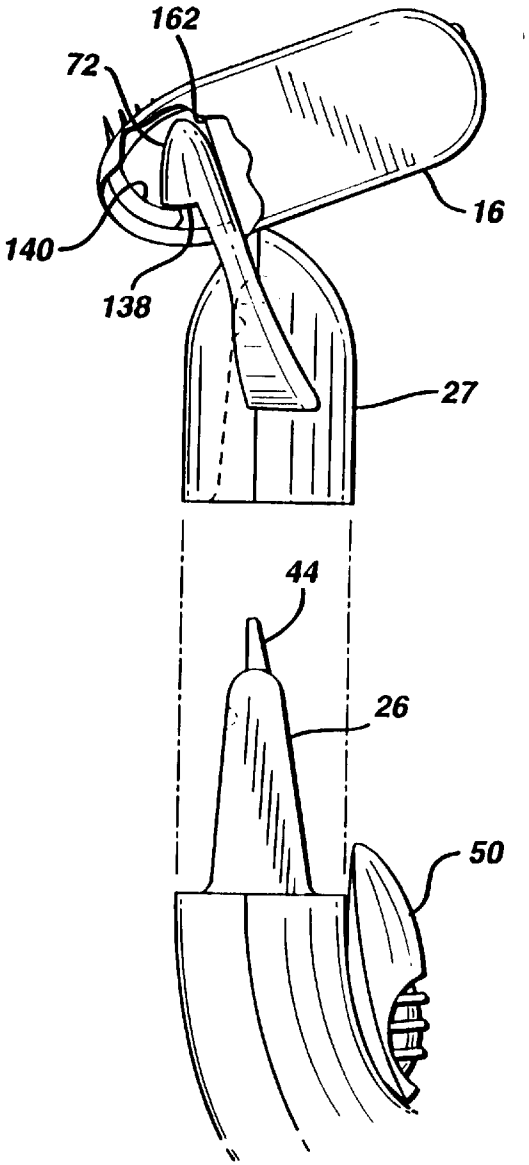
FIG. 16 is a side view, partially broken away, showing a housing of the FIG. 13 cartridge in an unbiased pivotal position with respect to a base structure of the cartridge prior to connection to a handle.
Figure 18:
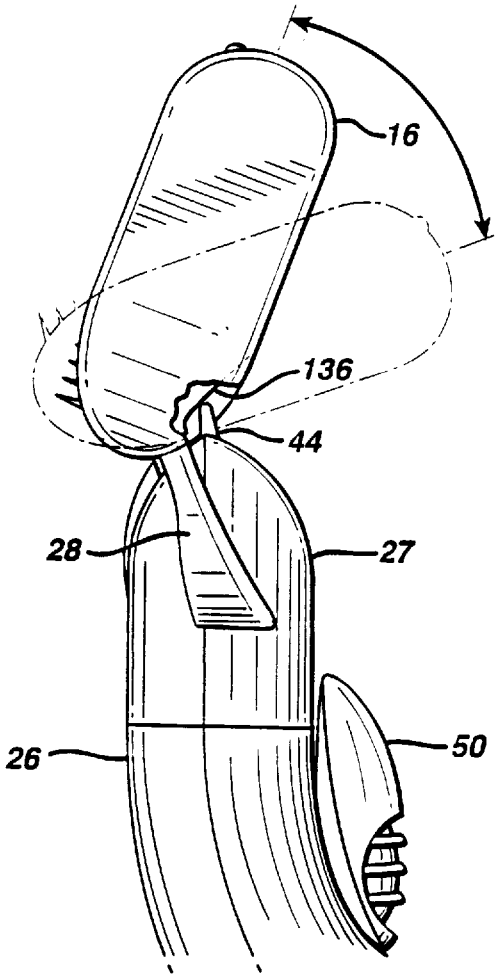
FIG. 18 is a side view, partially broken away, showing the range of pivotal movement of the FIG. 13 replaceable cartridge.

Referring to FIGS. 16–18, it is seen that each pivotal support end 72 has a lower curved surface 138 that slides on upper curved surface 140 of housing 16, providing a pivot axis at the center of a circle that includes surface 140. The pivot axis thus is in front of the blades in the region of guard 20. FIG. 16 shows housing 16 in an unbiased position in which pivotal support ends 72 support the front surface of guide wall 162. FIG. 17 shows the forwardly biased position for housing 16, in which case the forward surface of pivot support ends 72 are pushed up against a forward wall portion of housing 16. This is the at rest position for housing 16 prior to shaving. The forwardly-biased at rest position is achieved by contouring camming surface 136 so that plunger 44 having cam follower surface 102 has an at rest position near the front of housing 16, as shown in FIG. 18.

FIG. 18 shows the range of pivotal motion for housing 16. During shaving, cap 22 will initially contact the user's skin, and housing 16 will pivot clockwise and generally follow the contours of the user's face, being biased by plunger 44. The cap up initial orientation will cause the blade closer to cap 22 to initially be pushed against the skin more than the blades closer to the guard. However, the pivot at the region of guard and the light return force cause the cartridge to be "guard heavy" during shaving, with a higher load on the guard than the cap. The three blades are provided with progressive initial exposures, defined as the perpendicular distance or height of the blade edge measured with respect to a plane tangential to the skin contacting surfaces of the cartridge components immediately in front of and behind each blade. In particular, the primary blade has a negative initial exposure, the second blade has zero initial exposure, and the third blade has positive initial exposure. The spring constants and preloads for the blades are the same, and the blades have "progressive force" distribution during shaving; i.e., the force on the third blade is greater than the force on the first blade, and the force on the second blade is intermediate to the forces on the first and third blades or equal to the force on either the first or third blade. It is believed that beneficial shaving results are achieved when cartridges with three resiliently mounted blades exhibit, during shaving, such a progressive force pattern.

OTHER EMBODIMENTS

Figure 20:
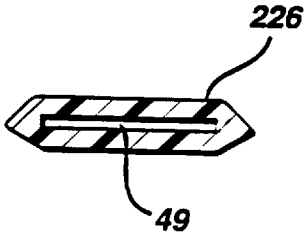
FIG. 20 is a sectional view of an alternative embodiment of an extension of the FIG. 2 handle.

Other embodiments of the invention are within the scope of the appended claims. The base structure could be held on the housing with a releasable latch. The blades could be loaded from the bottom instead of the top. The cartridge support structure could be made as a unit separate from the handle and attached to it. In place of trapezoidal extension 26 (FIG. 19), a six-sided extension 226 (FIG. 20), or other asymmetrical shape could be employed.

Figure 21:
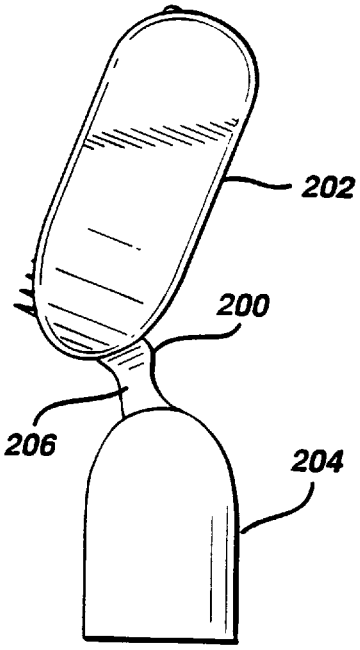
FIGS. 21 and 22 are side views of alternative embodiments of cartridges having different pivotal support structures.
Figure 22:
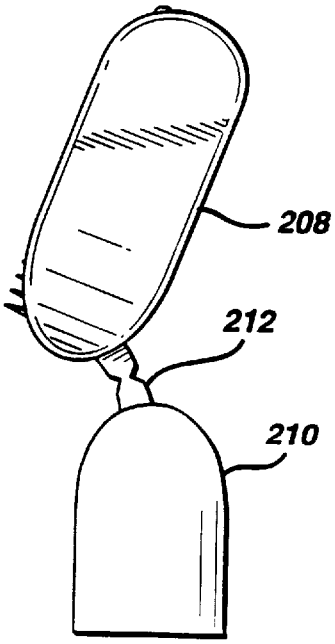

The pivotal connection could be provided by pins in respective holes, shell bearings, and other techniques. E.g., referring to FIG. 21, the pivotal support structure could be provided by a flexible plastic hinge portion 200 that is made of material that is more flexible than the housing 202 and connects the housing 202 and interconnect member 204 at a pivot region 206; these components could be made by two-color molding. Alternatively, referring to FIG. 22, the housing 208 and the interconnect member 210 may be made of the same piece of plastic, and the pivotal support structure may be provided by a living hinge 212. A living hinge could also be used with housings and interconnect members of different plastics.

What is claimed is:

1. A shaving handle comprising an elongated hand gripping structure including a frame member having an upper region and generally opposite thereof a lower region, and a cartridge support structure extending from an end of said hand gripping structure, said elongated hand gripping structure further comprising at least two gripping portions, each gripping portion comprising an elastomeric plastic outer gripping layer and a nonelastomeric plastic support layer thereunder having extensions that are press-fitted into said elongated hand gripping structure, said elastomeric outer gripping layer being molded to said nonelastomeric support layer and overlying a major portion of said nonelastomeric support layer, and one of said at least two gripping portions being in overlying relation to said upper region of said frame of said elongated hand gripping structure, and another of said at least two gripping portions being in overlying relation to said lower region of said frame of said elongated hand gripping structure, said gripping portions attachable along inwardly oriented axes to attach to said hand gripping structure, whereby said hand gripping structure is sandwiched between the at least two gripping portions.

2. The shaving handle of claim 1, wherein said hand gripping structure further comprises a plurality of elongate slots, said slots having a dimension not greater than said extensions of said at least two gripping portions, whereby the extensions undergo plastic deformation upon insertion into said slots along an insertion direction extending into said slots.

3. The shaving handle of claim 2, wherein the gripping portion extensions prior to insertion are free of undercuts transverse to the insertion direction.

4. The shaving handle of claim 2, wherein the slots have projections that extend into said slots transverse to said insertion direction, said projections defining said dimension and forming an interference fit with the extensions.

5. The shaving handle of claim 1, wherein said elongated hand gripping structure has a longitudinal axis, each said at least two gripping portion outer elastomeric layers extending uninterrupted between handle peripheral edges in a width direction transverse to the longitudinal axis.

6. The razor handle of claim 1 wherein said frame includes a recess, and wherein said hand gripping structure further comprises a weight in said recess, and wherein said extensions are press-fitted into said weight of said elongated hand gripping structure.

7. A shaving razor handle comprising an elongated hand gripping structure, and a cartridge support structure extending from an end of said hand gripping structure, said elongated hand gripping structure including a gripping portion comprising an elastomeric plastic outer gripping layer and a nonelastomeric plastic support layer thereunder having extensions that are press-fitted into said elongated hand gripping structure, wherein said elongated hand gripping structure is made of plastic and defines a recess, and further comprising a weight in said recess, said extensions extending into said weight.

8. The shaving razor handle of claim 7 wherein said elongated hand gripping structure is made of metallic-colored plastic.

9. A shaving razor handle comprising an elongated hand gripping structure, and a cartridge support structure extending from an end of said hand gripping structure, said elongated hand gripping structure including a gripping portion comprising an elastomeric plastic outer gripping layer and a nonelastomeric plastic support layer thereunder having extensions that are press-fitted into said elongated hand gripping structure, wherein said elongated hand gripping structure is made of plastic and defines a recess, and further comprising a weight in said recess, wherein said gripping portion is press-fitted into said weight.

10. The shaving razor handle of claim 9, wherein there is a plurality of gripping portions press-fitted into said weight.

11. A shaving handle comprising an elongated hand gripping structure, a cartridge support structure extending from an end of said hand gripping structure, said elongated hand gripping structure further comprising an elongated first handle portion comprising a plastics material, said elongated handle portion defining a weight receiving region, a metal weight disposed in said weight receiving region, and said elongated handle portion comprising an elastomeric plastic outer gripping layer molded with a nonelastomeric plastic support layer thereunder having extensions attached into said weight.

12. The shaving handle of claim 11, wherein said hand gripping structure further comprises at least a second handle portion, said second handle portion disposed on a side of said weight opposite said first handle portion, said second handle portion comprising an elastomeric plastic outer gripping layer molded with a nonelastomeric plastic support layer thereunder having extensions attached into said weight.

13. A shaving razor handle shank comprising first and second handle members defining gripping surfaces for a hand of a user, each said handle member having a plurality of inwardly extending posts, a weight having a plurality of location and securement apertures, wherein said weight is retainedly sandwiched between said first and second handle members, and wherein said first handle member comprises an elastomeric plastic outer gripping layer molded with a nonelastomeric plastic support layer thereunder having said inwardly extending posts.

14. The shaving razor handle shank of claim 13, further comprising an intermediate handle frame member having an open central region, said weight being disposed in said central region, and said first and second handle members overlie opposed upper and lower surfaces of said frame member.

15. The shaving razor handle shank of claim 14, wherein the frame member carries a cartridge support structure extending from a longitudinal end thereof.

16. A shaving handle comprising an elongated hand gripping structure, a cartridge support structure extending from an end of said hand gripping structure, said elongated hand gripping structure having a recess and a metal weight received in said recess, and including a gripping portion comprising an elastomeric plastic outer gripping layer molded with a nonelastomeric plastic support layer thereunder having extensions that are secured in said weight.

17. The shaving handle of claim 16, wherein said elongated hand gripping structure is made of plastic.

* * * * *